US007950247B2

(12) United States Patent
Lee et al.

(10) Patent No.: US 7,950,247 B2
(45) Date of Patent: May 31, 2011

(54) REFRIGERATOR RELATED TECHNOLOGY

(75) Inventors: Youn Seok Lee, Seoul (KR); Jang Seok Lee, Seoul (KR); Min Kyu Oh, Seoul (KR); Kyeong Yun Kim, Seoul (KR); Su Nam Chae, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/634,784

(22) Filed: Dec. 10, 2009

(65) Prior Publication Data

US 2010/0180619 A1 Jul. 22, 2010

(30) Foreign Application Priority Data

Jan. 21, 2009 (KR) ..... 10-2009-0005009

(51) Int. Cl.
*F25D 17/06* (2006.01)

(52) U.S. Cl. ..... 62/414; 62/419

(58) Field of Classification Search ..... 62/414, 62/285, 291, 277, 407, 419, 440, 442, 448; 312/116, 117; 454/15, 105, 216
See application file for complete search history.

(56) References Cited

U.S. PATENT DOCUMENTS

| | | | | |
|---|---|---|---|---|
| 3,122,899 | A * | 3/1964 | Costantini et al. | 62/419 |
| 3,599,442 | A * | 8/1971 | Hanson | 62/239 |
| 3,712,078 | A * | 1/1973 | Maynard et al. | 62/448 |
| 5,086,627 | A * | 2/1992 | Borgen | 62/229 |
| 5,284,023 | A * | 2/1994 | Silva et al. | 62/77 |
| 5,622,059 | A * | 4/1997 | McClellan | 62/448 |
| 6,467,859 | B2 * | 10/2002 | Branz et al. | 312/292 |
| 6,735,976 | B2 | 5/2004 | Lee | |
| 6,997,008 | B2 | 2/2006 | Lee et al. | |
| 7,003,973 | B2 | 2/2006 | Lee et al. | |
| 7,040,118 | B2 | 5/2006 | Jung | |
| 7,114,345 | B2 | 10/2006 | Kim et al. | |
| 7,185,509 | B2 | 3/2007 | Lee et al. | |
| 7,188,490 | B2 | 3/2007 | Jeong et al. | |
| 7,322,209 | B2 | 1/2008 | Hwang et al. | |
| 2002/0093276 | A1 * | 7/2002 | Kawakami | 312/405 |
| 2004/0040338 | A1 * | 3/2004 | Lee et al. | 62/441 |
| 2004/0139763 | A1 * | 7/2004 | Jeong et al. | 62/448 |
| 2004/0144130 | A1 * | 7/2004 | Jung | 62/513 |
| 2004/0163408 | A1 * | 8/2004 | Kim et al. | 62/428 |
| 2005/0218766 | A1 | 10/2005 | Hwang | |

FOREIGN PATENT DOCUMENTS

| | | |
|---|---|---|
| JP | 7-19704 | 1/1995 |

* cited by examiner

*Primary Examiner* — Mohammad Ali

(74) *Attorney, Agent, or Firm* — Fish & Richardson P.C.

(57) ABSTRACT

A refrigerator, in which a guide member is arranged at an inlet of a cold air generating compartment that houses an evaporator. The guide member uniformly distributes cold air introduced into the cold air generating compartment to upper and lower portions of the evaporator.

19 Claims, 5 Drawing Sheets

REFRIGERATOR RELATED TECHNOLOGY

CROSS REFERENCE TO RELATED APPLICATION

This application claims the benefit of Korean Patent Application No. 10-2009-0005009, filed on Jan. 21, 2009, which is hereby incorporated by reference as if fully set forth herein.

FIELD

The present disclosure relates to refrigerator technology.

BACKGROUND

A refrigerator is used to supply cold air generated at an evaporator to a storage compartment (e.g., a refrigerating and/or freezing compartment) to maintain freshness of various food products stored in the storage compartment. Such a refrigerator includes a body, in which a storage compartment is defined to store food in a low-temperature state therein. A door is mounted to a front side of the body to open or close the storage compartment.

A cooling cycle is included in the refrigerator to cool the storage compartment through circulation of a refrigerant. A machine compartment also is defined in the body to accommodate a plurality of electric elements used to configure the cooling cycle.

For instance, the cooling cycle includes a compressor to perform a temperature/pressure increasing operation upon a low-temperature/low-pressure gaseous refrigerant such that the low-temperature/low-pressure gaseous refrigerant is changed into a high-temperature/high-pressure gaseous refrigerant. The cooling cycle also includes a condenser to condense the refrigerant supplied from the compressor, using ambient air, an expansion valve to perform a pressure reducing operation upon the refrigerant supplied from the condenser such that the refrigerant is expanded, and an evaporator to evaporate the refrigerant emerging from the expansion valve in a low pressure state, thereby absorbing heat from the interior of the refrigerator.

A blowing fan is installed in the machine compartment to cool the compressor and condenser. Through holes are defined at opposite sides of the machine compartment to allow introduction and discharge of ambient air, respectively.

In accordance with the above-mentioned structure, ambient air is introduced into the interior of the machine compartment through one of the through holes (e.g., an inlet hole) when the blowing fan rotates. The introduced air passes along the condenser and compressor, and is then outwardly discharged from the machine compartment through the other through hole (e.g., an outlet hole). During this procedure, the condenser and compressor are cooled by the ambient air.

A refrigerator may be a top mount type in which freezing and refrigerating compartments are vertically arranged, and freezing and refrigerating compartment doors are mounted to the freezing and refrigerating compartments to open or close the freezing and refrigerating compartments, respectively. A refrigerator also may be a bottom freezer type in which freezing and refrigerating compartments are vertically arranged, hinged refrigerating compartment doors are pivotally mounted to left and right sides of the refrigerating compartment, and a drawer type freezing compartment door is mounted to the freezing compartment such that the freezing compartment door slides in forward and rearward directions of the freezing compartment to open or close the freezing compartment. A refrigerator further may be a side-by-side type in which freezing and refrigerating compartments are horizontally arranged for an increased refrigerator size, and freezing and refrigerating compartment doors are pivotally mounted to the freezing and refrigerating compartments in a side-by-side fashion to open or close the freezing and refrigerating compartments, respectively.

SUMMARY

In one aspect, a refrigerator includes a body, a storage compartment defined in a first portion of the body, a door configured to open and close at least a portion of the storage compartment, and a cold air generating compartment defined in an upper portion of the body and separated from the storage compartment. The upper portion of the body is positioned above the storage compartment when the refrigerator is oriented in an ordinary operating orientation. The refrigerator also includes an evaporator positioned in the cold air generating compartment and a cold air fan positioned in the cold air generating compartment and configured to promote movement of air within the cold air generating compartment in a flow direction that passes over the evaporator and is perpendicular to a surface of the door when the door is oriented in a closed position. The refrigerator further includes a guide member positioned at an inlet of the cold air generating compartment and configured to guide air passing through the inlet of the cold air generating compartment toward the evaporator.

Implementations may include one or more of the following features. For example, the guide member includes an inlet through which cold air passes and a plurality of blades positioned at the inlet and configured to guide cold air in a direction upward from the inlet of the cold air generating compartment toward an upper portion of the cold air generating compartment. The plurality of blades may be arranged such that a spacing between adjacent ones of the blades is gradually reduced from a top of the guide member to a bottom of the guide member. A distance between the bottom of the guide member and the inlet of the cold air generating compartment may be less than a distance between the top of the guide member and the inlet of the cold air generating compartment.

The plurality of blades may be inclined with respect to a vertical direction and may be configured to uniformly distribute cold air to upper and lower portions of the evaporator. The plurality of blades may have inclination angles that gradually reduce with respect to a vertical direction as the blades are positioned further away from an upper end of the guide member. The upper and of the guide member may be an end of the guide member positioned furthest from the inlet of the cold air generating compartment.

In some examples, an uppermost one of the blades, which is closest to an upper end of the guide member, has an inclination angle of 70° with respect to a vertical axis. The upper end of the guide member may be an end of the guide member positioned furthest from the inlet of the cold air generating compartment. In these examples, a lowermost one of the blades, which is farthest from the upper end of the guide member, has an inclination angle of 45° with respect to the vertical axis and remaining ones of the blades have inclination angles that are between 70° and 45° with respect to the vertical axis and that gradually reduce as the remaining blades are positioned further away from the upper end of the guide member.

In addition, the refrigerator may include an air guide arranged at an upper end of the guide member and configured to guide cold air emerging from the storage compartment to the evaporator. The upper end of the guide member may be an end of the guide member positioned furthest from the inlet of the cold air generating compartment. The air guide may have a concave shape with respect to a cold air introduction direction of cold air flowing through the guide member.

In some implementations, the refrigerator may include a heat transfer member that connects the guide member and the evaporator and is configured to cool a surface of the guide member, thereby reducing moisture from the air passing through the guide member. The refrigerator also may include a drain pan arranged beneath the evaporator and configured to receive defrost water. The drain pan may extend to a lower end of the guide member.

A length of the evaporator perpendicular to the flow direction of cold air along the evaporator may be longer than a length of the evaporator parallel to the flow direction of the cold air. The guide member may be made of an aluminum or copper material. The guide member may be configured to guide air passing through the inlet of the cold air generating compartment uniformly to the evaporator.

In another aspect, a refrigerator includes a body, a storage compartment defined in a first portion of the body, a door configured to open and close at least a portion of the storage compartment, and a cold air generating compartment defined in an upper portion of the body and separated from the storage compartment. The upper portion of the body may be positioned above the storage compartment when the refrigerator is oriented in an ordinary operating orientation. The refrigerator also includes an evaporator positioned in the cold air generating compartment and a cold air fan positioned in the cold air generating compartment and configured to promote movement of air within the cold air generating compartment in a flow direction that passes over the evaporator and is perpendicular to a surface of the door when the door is oriented in a closed position. The refrigerator further includes a guide member provided at an inlet of the cold air generating compartment that receives air from the storage compartment. The guide member defines a plurality of cold air inlets having different sizes.

Implementations may include one or more of the following features. For example, the sizes of the plurality of cold air inlets gradually reduce from a top of the guide member to a bottom of the guide member. A distance between the bottom of the guide member and the inlet of the cold air generating compartment may be less than a distance between the top of the guide member and the inlet of the cold air generating compartment.

In some examples, the refrigerator may include a plurality of blades positioned at the cold air inlets and configured to guide cold air to the cold air generating compartment. The blades may be arranged such that a spacing between adjacent ones of the blades is gradually reduces from a top of the guide member to a bottom of the guide member. A distance between the bottom of the guide member and the inlet of the cold air generating compartment may be less than a distance between the top of the guide member and the inlet of the cold air generating compartment. In these examples, the plurality of blades may be inclined with respect to a vertical direction and may be configured to uniformly distribute cold air to upper and lower portions of the evaporator.

The refrigerator may include a plurality of blades positioned at the cold air inlets. The plurality of blades may have inclination angles that gradually reduce with respect to a vertical direction as the blades are positioned further away from an upper end of the guide member. The upper end of the guide member may be an end of the guide member positioned furthest from the inlet of the cold air generating compartment. An uppermost one of the blades, which is closest to the upper end of the guide member, may have an inclination angle of 70° with respect to the vertical axis. A lowermost one of the blades, which is farthest from the upper end of the guide member, may have an inclination angle of 45° with respect to the vertical axis. Remaining ones of the blades may have inclination angles that are between 70° and 45° with respect to the vertical axis and that gradually reduce as the remaining blades are positioned further away from the upper end of the guide member. A length of the evaporator perpendicular to the flow direction of cold air along the evaporator may be longer than a length of the evaporator parallel to the flow direction of the cold air.

DETAILED DESCRIPTION

Figure 1:
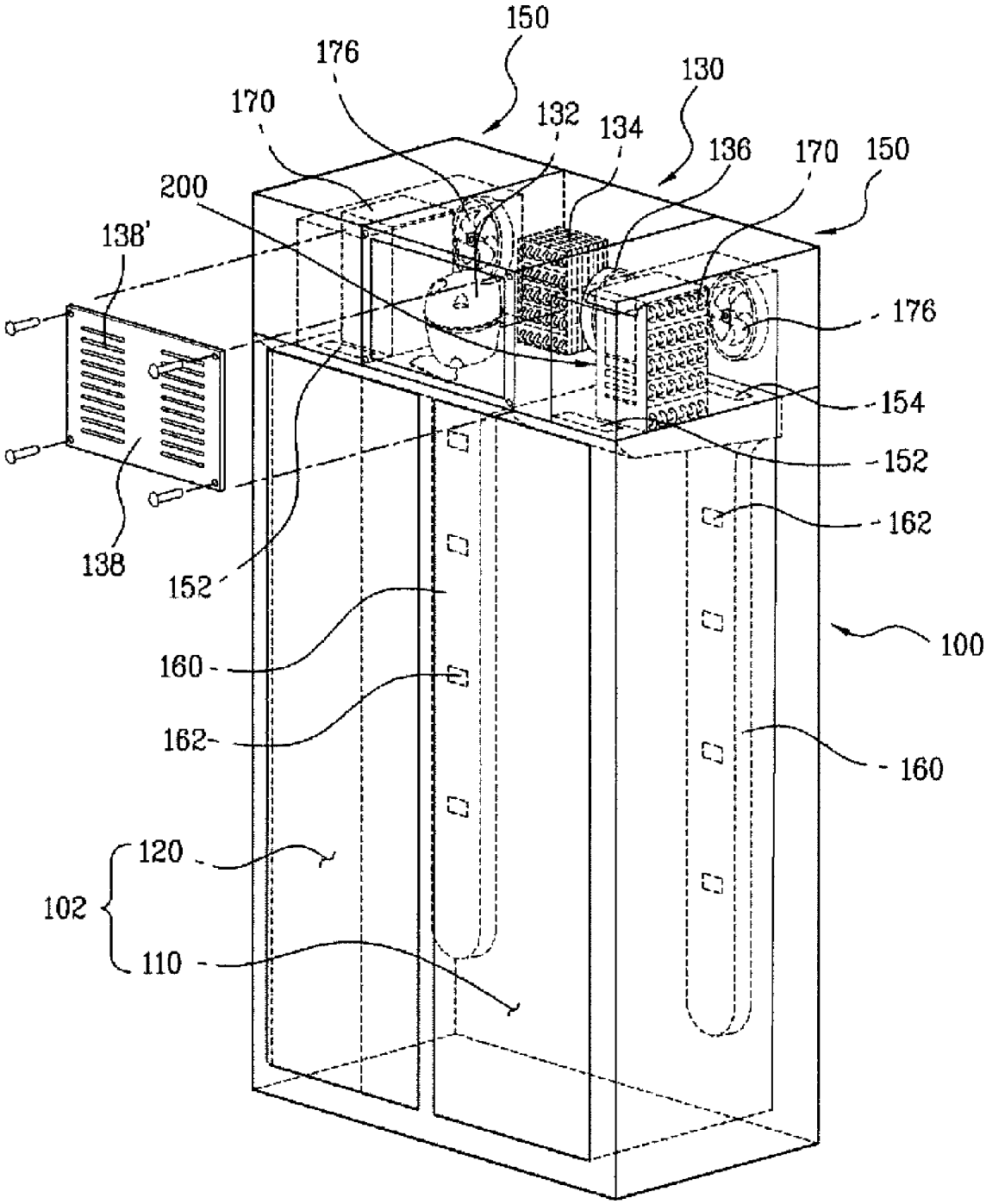
FIG. 1 is a perspective view illustrating an example configuration of a refrigerator.
Figure 2:
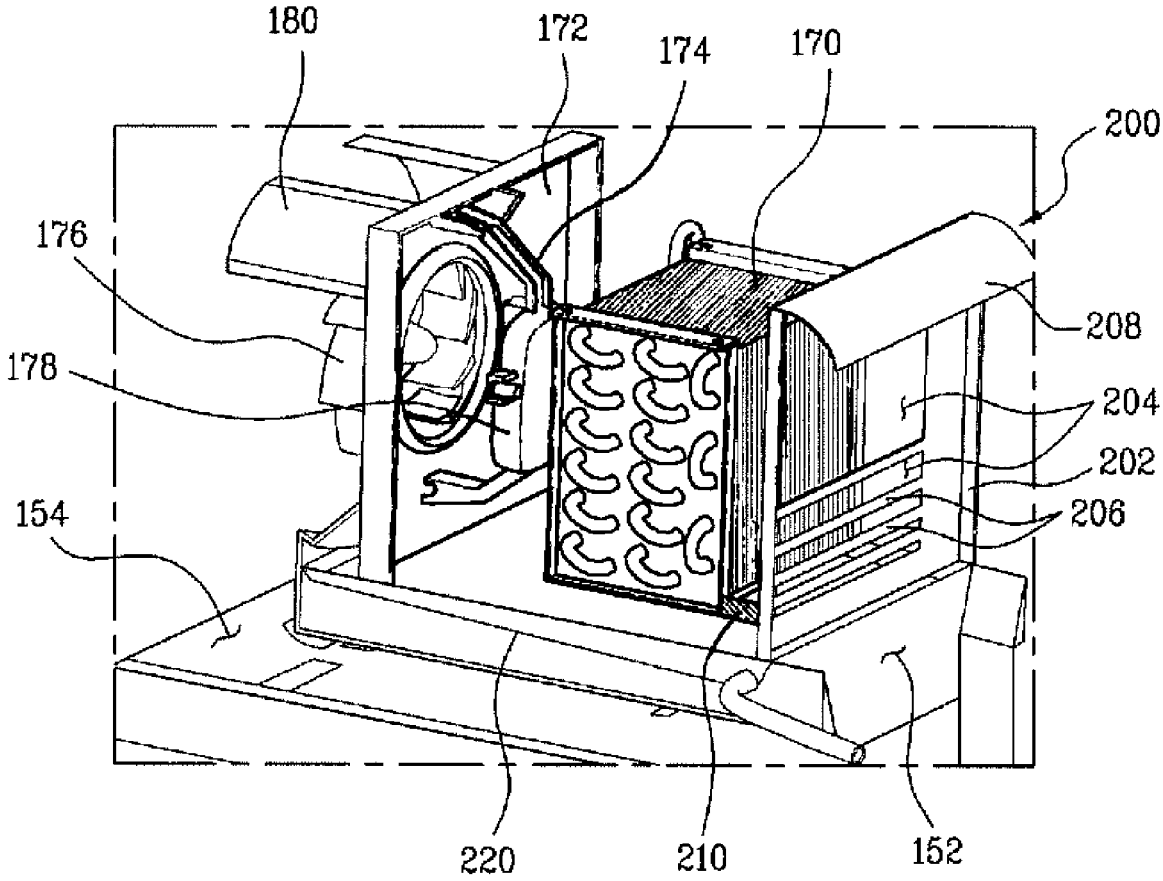
FIGS. 2 and 3 are a perspective view and a side view illustrating an example structure of a cold air generating compartment.
Figure 3:
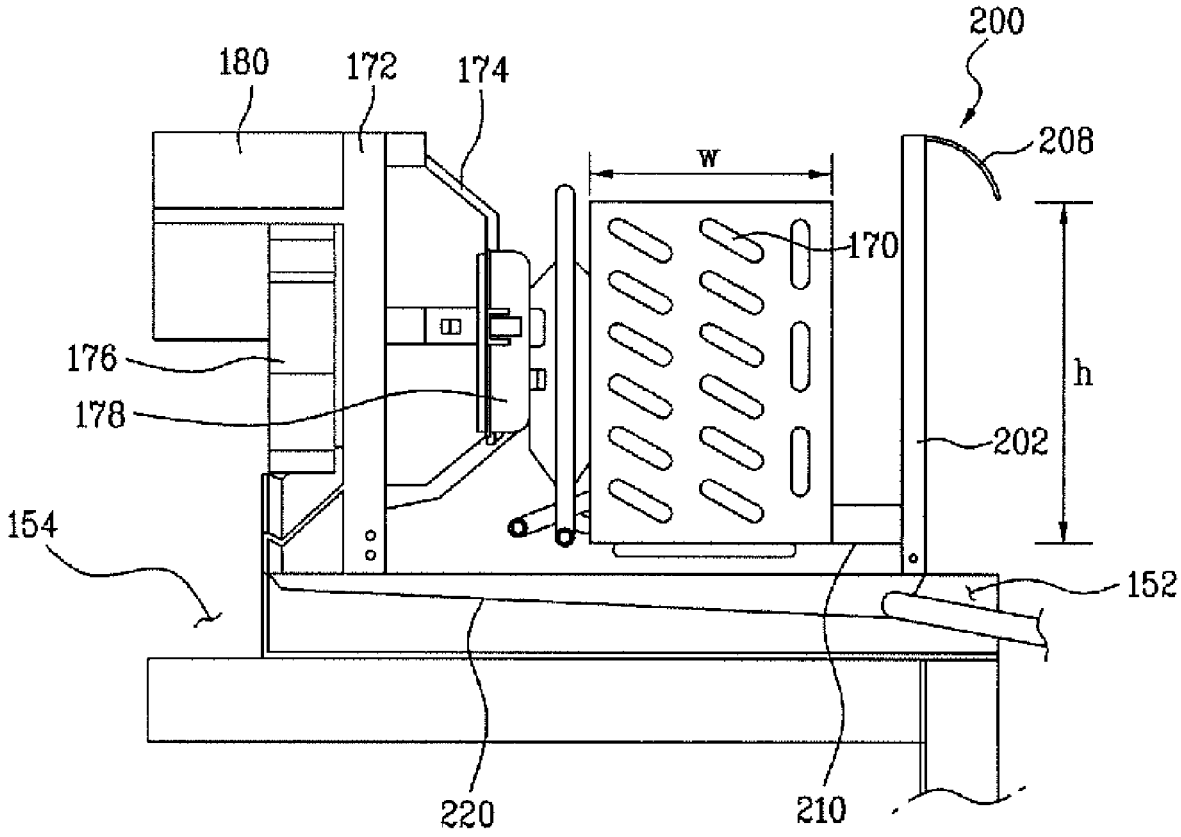
Figure 4:
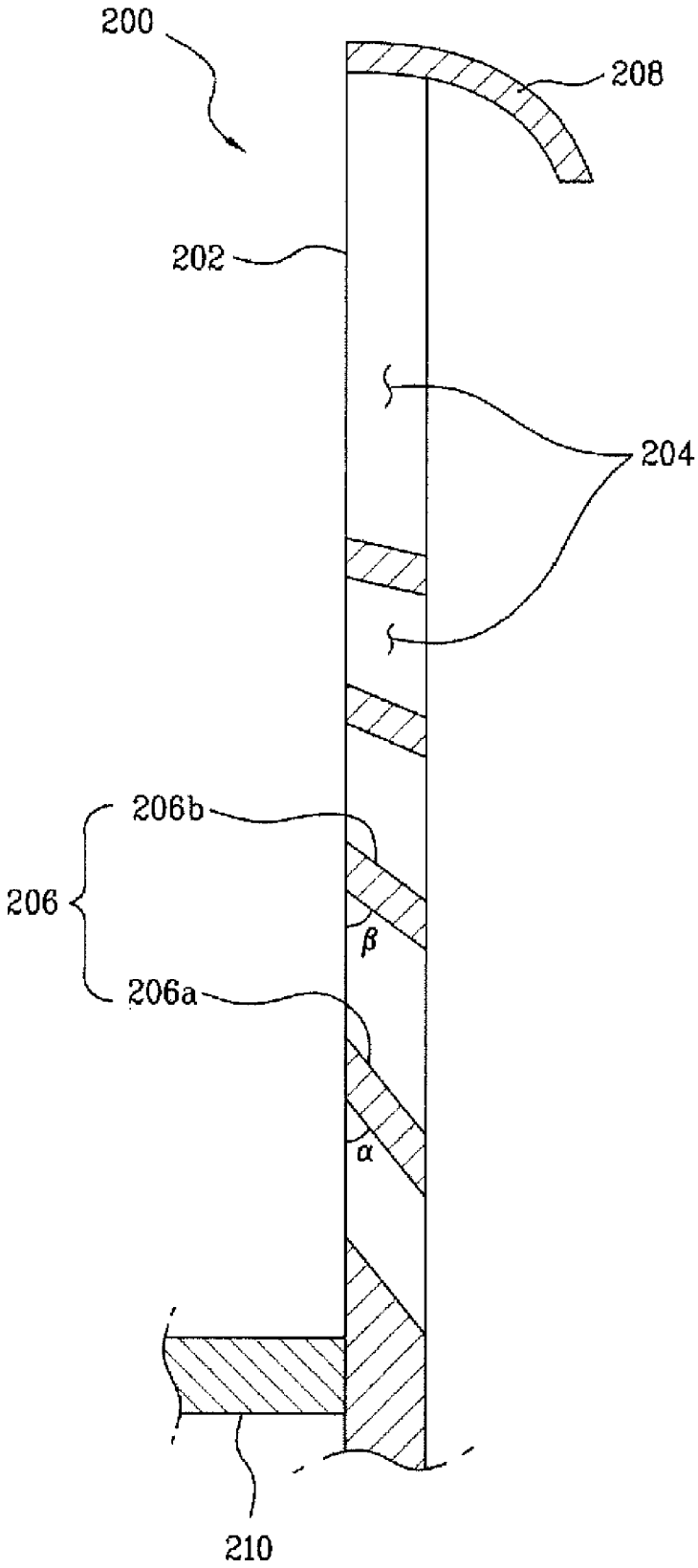
FIG. 4 is a sectional view illustrating an example configuration of a guide member.

FIG. 1 illustrates an example configuration of a refrigerator. FIGS. 2 and 3 illustrate an example structure of a cold air generating compartment. FIG. 4 illustrates an example configuration of a guide member.

As shown in the drawings, in a body 100 that defines a frame of the refrigerator, a storage compartment 102 is defined. The storage compartment 102 is a space to store food in a low-temperature state using cold air generated around an evaporator 170. A plurality of racks may be vertically arranged in the storage compartment 102. A drawer type storage compartment may be defined beneath the racks.

The storage compartment 102 includes a refrigerating compartment 110 and a freezing compartment 120. The refrigerating compartment 110 and freezing compartment 120 are separated from each other by a partition wall so that they define separate storage spaces.

A machine compartment 130 also is defined in the body 100. The machine compartment 130 is arranged at an upper portion of the body 100. In other examples, the machine compartment 130 may be arranged at a lower portion of the body 100 in accordance with design conditions. An accommodation space is defined in the machine compartment 130. In the accommodation space, one or more elements of a refrigeration cycle are accommodated. For instance, a compressor 132, a condenser 134, an expansion valve, and a blowing fan 136 are arranged in the machine compartment 130.

The compressor 132 functions to compress a low-temperature/low-pressure gaseous refrigerant circulating the refrigeration cycle into a high-temperature/high-pressure gaseous refrigerant. The refrigerant emerging from the compressor 132 is introduced into the condenser 134.

The condenser 134 phase-changes the refrigerant compressed by the compressor 132 into a normal-temperature/high-pressure liquid refrigerant through heat exchange. The condenser 134 includes a tubular refrigerant pipe repeatedly bent multiple times. The refrigerant pipe of the condenser 134 is repeatedly bent multiple times to have continuous pipe portions spaced apart from one another by a uniform gap. In accordance with the repeated bending of the refrigerant pipe, the condenser 134 generally has a rectangular hexahedral shape. The blowing fan 136 is arranged in the vicinity of the condenser 134 to blow ambient air toward the condenser 134.

The refrigerant emerging from the condenser 134 passes through the expansion valve. The expansion valve has a reduced diameter, as compared to those of other parts, to reduce the pressure of the refrigerant emerging from the condenser 134, and thus to expand the refrigerant.

A cover member 138 is arranged at a front side of the machine compartment 130 to screen the accommodation space. Through holes 138' are defined through the cover member 138 to allow ambient air to be introduced into the machine compartment 130 or to allow air present in the machine compartment 130 to be outwardly discharged.

A cold air generating compartment 150 also is defined in the body 100. The cold air generating compartment 150 is a space in which one or more components that generate cold air are installed in order to maintain the storage compartment 102 at low temperature. The cold air generating compartment 150 extends from a front side of the body 100 to a rear side of the body 100 in a longitudinal direction. As shown in FIG. 1, the cold air generating compartment 150 is arranged at the upper portion of the body 100 adjacent to the machine compartment 130, while being separated from the storage compartment 102 by one or more walls.

A cold air inlet 152 and a cold air outlet 154 are provided at the cold air generating compartment 150. The cold air inlet 152 is a port through which cold air from the storage compartment 102 is introduced into the cold air generating compartment 150. The cold air outlet 154 is a port through which cold air is discharged from the cold air generating compartment 150 so as to be guided to the storage compartment 102.

A guide duct 160 is provided at the body 100. The guide duct 160 defines a path to circulate the cold air generated by the evaporator 170 to the storage compartment 102. The guide duct 160 communicates with the storage compartment 102 and cold air generating compartment 150. As shown in FIG. 1, the guide duct 160 extends from the cold air generating compartment 150 to a lower portion of the storage compartment 102.

A cold air outlet 162 is positioned at the guide duct 160. The cold air outlet 162 is defined through one wall of the guide duct 160 such that it is opened to the storage compartment 102. As shown in FIG. 1, a plurality of cold air outlets 162 are provided. The cold air outlets 162 supply cold air from the guide duct 160 to the storage compartment 102. The cold air outlet 162 may be defined between the top of the storage compartment 102 and an uppermost one of the racks and between adjacent ones of the racks. In the cold air generating compartment 150, a cold air fan 176 is installed together with the evaporator 170 such that they are horizontally arranged.

The evaporator 170 is configured to absorb heat from the surroundings when a liquid present in the evaporator 170 is changed into a gas and, thereby, decreases the temperature of the surroundings. Thus, the evaporator 170 absorbs heat from the surroundings as the refrigerant emerging from the expansion valve is evaporated in a low-pressure state.

As shown in FIGS. 2 and 3, the evaporator 170 has a vertical length h perpendicular to a flow direction of cold air along the evaporator 170 and a horizontal length w parallel to the flow direction of cold air such that the vertical length h is longer than the horizontal length w. In the evaporator 170, the vertical length h perpendicular to the flow direction of cold air along the evaporator 170 may be longer than the horizontal length w parallel to the flow direction of cold air because the cold air generating compartment 150 extends in a horizontal direction, and cold air is introduced into and discharged out of the cold air generating compartment 150 at front and rear sides of the cold air generating compartment 150, respectively.

An orifice 172 is provided in the cold air generating compartment 150. The orifice 172 is arranged adjacent to the evaporator 170 at a rear portion of the cold air generating compartment 150. The orifice 172 includes an orifice hole and a motor support 174.

The cold air fan 176 is connected to the orifice hole of the orifice 172. The cold air fan 176 discharges air as vanes thereof rotate to provide ventilation or heat removal. The cold air fan 176 generates a flow of cold air circulating the storage compartment 102, cold air generating compartment 150, etc. The cold air fan 176 may comprise any one of a centrifugal fan, an axial fan, or a cross-flow fan.

A fan motor 178 is supported by the motor support 174. The fan motor 178 is arranged at the orifice 172 adjacent to the evaporator 170. The fan motor 178 provides a driving force to drive the cold air fan 176.

A guide member 180 is arranged at one side of an upper end of the orifice 172. The guide member 180 guides cold air discharged from the cold air fan 176 to the cold air outlet 154.

Another guide member 200 is provided in the cold air generating compartment 150. The guide member 200 is arranged at an inlet of the cold air generating compartment 150, through which cold air emerging from the storage compartment 102 is drawn into the cold air generating compartment 150. The guide member 200 uniformly distributes the cold air to upper and lower portions of the cold air generating compartment 150. For example, the guide member 200 guides the cold air passing through the cold air inlet 152 to flow through the evaporator 170.

The guide member 200 is made of a metallic material having a high thermal conductivity. Accordingly, when cold air containing moisture is introduced into the cold air generating compartment 150, the moisture is attached to the guide member 200. As a result, dry cold air passes along the evaporator 170 because the moisture of the cold air has been attached to the guide member 200. Thus, frosting of the evaporator 170 may be reduced. The guide member 200 may be made of an aluminum or copper material, which may provide an enhancement in thermal conductivity.

As shown in FIGS. 2 and 4, the frame of the guide member 200 is defined by a body 202. The body 202 has a substantially-rectangular shape. The body 202 is, at an outer surface thereof, in close contact with an inner surface of the cold air generating compartment 150.

The body 202 is provided with an inlet 204 through which cold air passes. A plurality of blades 206 are provided at the body 202. The blades 206 guide the cold air introduced through the cold air inlet 152 to the cold air generating compartment 150.

The plurality of blades 206 are arranged such that the spacing between adjacent ones of the blades 206 is gradually reduced as the guide member 200 extends downwardly. The blades 206 divide the inlet 204 into a plurality of inlet portions to uniformly distribute, to the cold air generating compartment 150, the cold air flowing toward the guide member 200.

The plurality of blades 206 are inclined with respect to a vertical direction in order to uniformly distribute cold air to upper and lower portions of the evaporator 170. The plurality of blades 206 have inclination angles gradually reduced with respect to a vertical direction as they are spaced away from an upper end of the guide member 200, respectively.

Two adjacent blades 206 (e.g., a first blade **206*a* and a second blade 206*b*) are described in more detail below. The first blade 206*a* has a first inclination angle $\alpha$ with respect to a vertical axis, whereas the second blade 206***b* has a second inclination angle β with respect to the vertical axis. In this case, the first inclination angle α is smaller than the second inclination angle β.

Thus, the blades 206 have different inclination angles according to the distances and relative positions of the blades 206 from the upper end of the guide member 200.

For example, the uppermost one of the blades 206, which is closest to the upper end of the guide member 200, has an inclination angle of 70° with respect to the vertical axis. The lowermost one of the blades 206, which is farthest from the upper end of the guide member 200, has an inclination angle of 45° with respect to the vertical axis. The remaining blades 206 have inclination angles gradually reduced between 70° and 45° with respect to the vertical axis as they are spaced away from the upper end of the guide member 200.

Because the blades 206 are inclined such that extension lines thereof are directed to the top of the cold air generating compartment 150, as described above, the cold air introduced into the cold air generating compartment 150 is uniformly distributed to the evaporator 170. Based on this configuration, cooling efficiency of the evaporator 170 may be increased due to concentration of the cold air to the lower portion of the evaporator 170.

In addition, an air guide 208 is provided at the guide member 200. The air guide 208 is arranged at the upper end of the guide member 200 to guide cold air emerging from the storage compartment 102 to the inlet 204. The air guide 208 has a shape concave in a cold air introduction direction.

A heat transfer member 210 also is provided at the guide member 200. The heat transfer member 210 is connected to the guide member 200 to cool the guide member 200. To this end, the heat transfer member 210 may be made of aluminum or copper having a high thermal conductivity. A defrost heater also is provided at the guide member 200 to remove frost present on the surface of the guide member 200.

A drain pan 220 is arranged beneath the evaporator 170 to remove defrost water. The drain pan 220 extends to a lower end of the guide member 200 beneath the lower end of the evaporator 170. The guide member 200 is arranged on the drain pan 220. Accordingly, the drain pan 220 can remove not only defrost water generated at the evaporator 170, but also defrost water generated at the guide member 200.

Examples of operation of the refrigerator having the above-described configuration will be described with reference to FIG. 5.

In the body 100, cold air present in the storage compartment 102 is introduced into the cold air generating compartment 150 after flowing through the cold air inlet 152 and guide member 200. The cold air is cooled in the cold air generating compartment 150 in accordance with heat exchange thereof with the evaporator 170. The cold air is then again introduced into the storage compartment 102 after sequentially passing through the cold air outlet 154 and guide duct 160.

Thus, in the refrigerator, heat exchange is performed in the cold air generating compartment 150 arranged at the upper portion of the body 100. Because the cold air generating compartment 150 extends in forward and rearward directions of the body 100 and the evaporator 170 and cold air fan 176 are installed in the forward and rearward directions of the body 100, the installation of the evaporator 170 and cold air fan 176 may be made without regard for the height of the cold air generating compartment 150, as compared to the case in which the evaporator 170 and cold air fan 176 are vertically arranged.

Also, the evaporator 170 is configured such that the length thereof perpendicular to the flow direction of cold air along the evaporator 170 is longer than the horizontal length thereof parallel to the flow direction of cold air. In the evaporator 170 having the above-described structure, the length of a flow path, through which cold air flows along the evaporator 170, is reduced for a constant heat exchange area, as compared to a structure in which the length of the evaporator perpendicular to the flow direction of cold air is shorter than the horizontal length of the evaporator parallel to the flow direction of cold air. As a result, the flow resistance of cold air may be reduced, as compared to the latter structure.

The cold air introduced into the cold air generating compartment 150 is concentrated to the bottom of the cold air generating compartment 150 due to the characteristics thereof. To this end, the plurality of blades 206 are arranged to be denser at the lower portion of the body 202. Accordingly, the inlet portions of the inlet 204 arranged at the upper portion of the guide member 200 define passages larger than those of the inlet portions of the inlet 204 arranged at the lower portion of the guide member 200.

Figure 5:
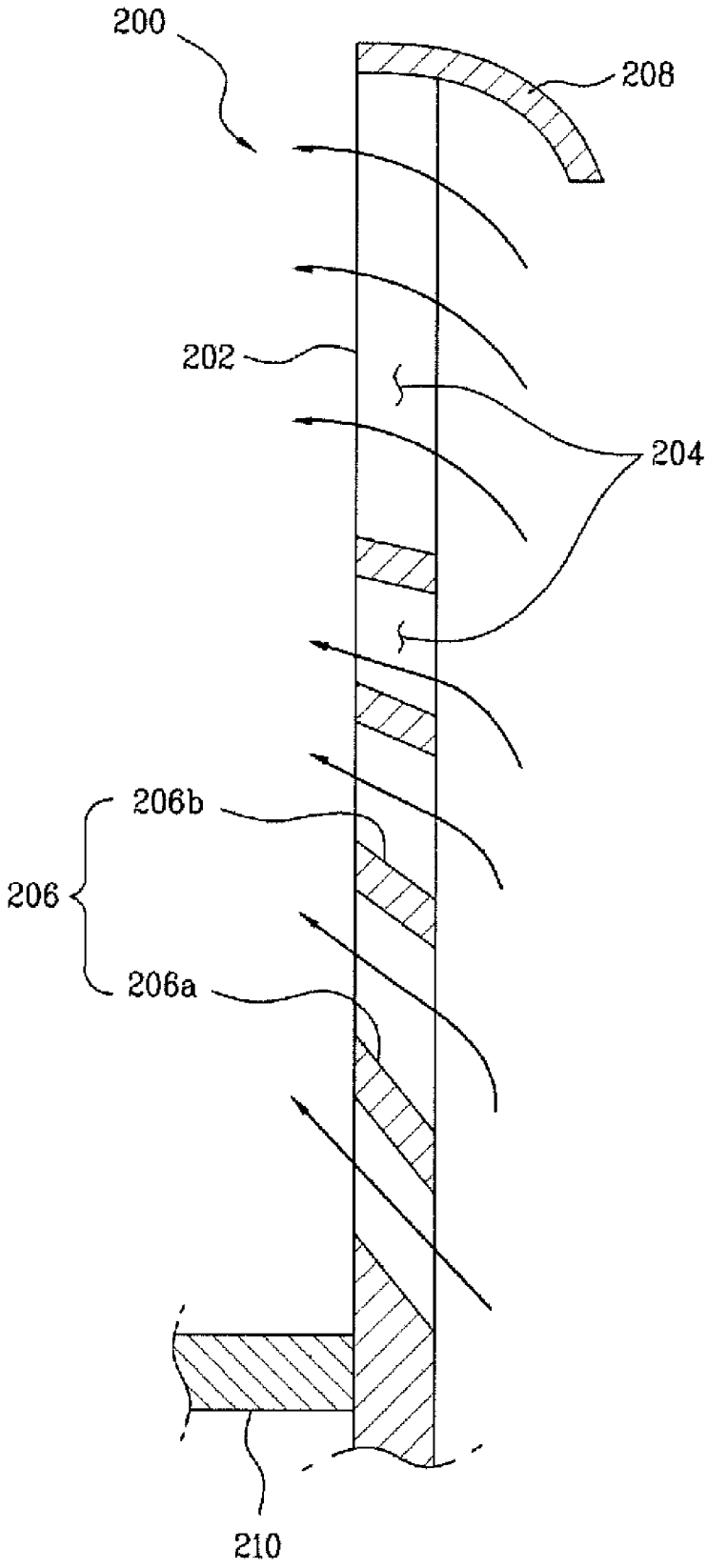
FIG. 5 is a schematic view illustrating example operation of the guide member shown in FIG. 4.

Since the inlet portions of the inlet 204 arranged at the lower portion of the guide member 200 are smaller than the inlet portions of the inlet 204 arranged at the upper portion of the guide member 200, as shown in FIG. 5, the cold air is uniformly distributed in a vertical direction without being concentrated to the lower portion of the cold air generating compartment 150.

Also, the plurality of blades 206 have inclination angles gradually reduced with respect to a vertical direction as they are spaced away from the upper end of the guide member 200. Accordingly, the cold air passing through the blades 206 flows toward the upper portion of the cold air generating compartment 150, so that it is uniformly distributed to the upper and lower portions of the evaporator 170.

In addition, the cold air passes through the guide member 200 when it is introduced into the cold air generating compartment 150. The guide member 200 is connected to the evaporator 170 via the heat transfer member 210, so that it is maintained at low temperature. Accordingly, when the cold air, which contains moisture, passes through the guide member 200, the moisture is attached to the surfaces of the guide member 200. As a result, the cold air, which passes along the evaporator 170, is in a relatively dry state.

Thus, the guide member 200 removes moisture from the cold air before the cold air passes along the evaporator 170, thereby reducing formation of frost on the surface of the evaporator 170. The frost formed on the guide member 200 is changed into defrost water by the defrost heater. The defrost water is introduced into the drain pan 220.

In some implementations, a guide member is arranged at an inlet of a cold air generating compartment where an evaporator is arranged. Accordingly, cold air introduced into the cold air generating compartment is uniformly distributed to upper and lower portions of the evaporator. As a result, heat exchange is uniformly achieved throughout the evaporator, so that an enhancement in cooling efficiency may be achieved.

In some examples, the guide member, which is arranged at the inlet of the cold air generating compartment, is maintained at low temperature. Accordingly, moisture contained in cold air is attached to the surfaces of the guide member while passing through the guide member, so that the cold air is in a relatively dry state when it passes along the evaporator. As a result, the defrosting interval is lengthened such that the cooling efficiency of the refrigerator may be enhanced.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator comprising:

a body;

a storage compartment defined in a first portion of the body;

a door configured to open and close at least a portion of the storage compartment;

a cold air generating compartment defined in an upper portion of the body and separated from the storage compartment, the upper portion of the body being positioned above the storage compartment when the refrigerator is oriented in an ordinary operating orientation;

an evaporator positioned in the cold air generating compartment;

a cold air fan positioned in the cold air generating compartment and configured to promote movement of air within the cold air generating compartment in a flow direction that passes over the evaporator and is perpendicular to a surface of the door when the door is oriented in a closed position; and a guide member positioned at an inlet of the cold air generating compartment and configured to guide air passing through the inlet of the cold air generating compartment toward the evaporator, wherein the guide member comprises:

an inlet through which cold air passes; and a plurality of blades positioned at the inlet of the guide member and configured to guide cold air in a direction upward from the inlet of the cold air generating compartment toward an upper portion of the cold air generating compartment such that air is uniformly introduced throughout the evaporator in a horizontal direction.

2. The refrigerator according to claim 1, wherein the plurality of blades are arranged such that a spacing between adjacent ones of the blades is gradually reduced from a top of the guide member to a bottom of the guide member, a distance between the bottom of the guide member and the inlet of the cold air generating compartment being less than a distance between the top of the guide member and the inlet of the cold air generating compartment.

3. The refrigerator according to claim 1, wherein the plurality of blades are inclined with respect to a vertical direction and are configured to uniformly distribute cold air to upper and lower portions of the evaporator.

4. The refrigerator according to claim 1, wherein the plurality of blades have inclination angles that gradually reduce with respect to a vertical direction as the blades are positioned further away from an upper end of the guide member, the upper end of the guide member being an end of the guide member positioned furthest from the inlet of the cold air generating compartment.

5. The refrigerator according to claim 1, wherein:

an uppermost one of the blades, which is closest to an upper end of the guide member, has an inclination angle of 70° with respect to a vertical axis, the upper end of the guide member being an end of the guide member positioned furthest from the inlet of the cold air generating compartment;

a lowermost one of the blades, which is farthest from the upper end of the guide member, has an inclination angle of 45° with respect to the vertical axis; and remaining ones of the blades have inclination angles that are between 70° and 45° with respect to the vertical axis and that gradually reduce as the remaining blades are positioned further away from the upper end of the guide member.

6. The refrigerator according to claim 1, further comprising:

an air guide arranged at an upper end of the guide member and configured to guide cold air emerging from the storage compartment to the evaporator, the upper end of the guide member being an end of the guide member positioned furthest from the inlet of the cold air generating compartment.

7. The refrigerator according to claim 6, wherein the air guide has a concave shape with respect to a cold air introduction direction of cold air flowing through the guide member.

8. The refrigerator according to claim 1, further comprising:

a heat transfer member that connects the guide member and the evaporator, and is configured to cool a surface of the guide member, thereby reducing moisture from the air passing through the guide member.

9. The refrigerator according to claim 1, further comprising:

a drain pan arranged beneath the evaporator and configured to receive defrost water, the drain pan extending to a lower end of the guide member.

10. The refrigerator according to claim 1, wherein a length of the evaporator perpendicular to the flow direction of cold air along the evaporator is longer than a length of the evaporator parallel to the flow direction of the cold air.

11. The refrigerator according to claim 1, wherein the guide member is made of an aluminum or copper material.

12. The refrigerator according to claim 1, wherein the guide member is configured to guide air passing through the inlet of the cold air generating compartment uniformly to the evaporator.

13. A refrigerator comprising:

a body;

a storage compartment defined in a first portion of the body;

a door configured to open and close at least a portion of the storage compartment;

a cold air generating compartment defined in an upper portion of the body and separated from the storage compartment, the upper portion of the body being positioned above the storage compartment when the refrigerator is oriented in an ordinary operating orientation;

an evaporator positioned in the cold air generating compartment;

a cold air fan positioned in the cold air generating compartment and configured to promote movement of air within the cold air generating compartment in a flow direction that passes over the evaporator and is perpendicular to a surface of the door when the door is oriented in a closed position;

a guide member provided at an inlet of the cold air generating compartment that receives air from the storage compartment, the guide member defining a plurality of cold air inlets having different sizes; and a plurality of blades positioned at the cold air inlets and configured to guide cold air to the cold air generating compartment such that the air is uniformly introduced throughout the evaporator in a horizontal direction.

14. The refrigerator according to claim 13, wherein the sizes of the plurality of cold air inlets gradually reduce from a top of the guide member to a bottom of the guide member, a distance between the bottom of the guide member and the inlet of the cold air generating compartment being less than a distance between the top of the guide member and the inlet of the cold air generating compartment.

15. The refrigerator according to claim 13, wherein the plurality of blades are arranged such that a spacing between adjacent ones of the blades is gradually reduces from a top of the guide member to a bottom of the guide member, a distance between the bottom of the guide member and the inlet of the cold air generating compartment being less than a distance between the top of the guide member and the inlet of the cold air generating compartment.

16. The refrigerator according to claim 15, wherein the plurality of blades are inclined with respect to a vertical direction and are configured to uniformly distribute cold air to upper and lower portions of the evaporator.

17. The refrigerator according to claim 13, wherein the plurality of blades have inclination angles that gradually reduce with respect to a vertical direction as the blades are positioned further away from an upper end of the guide member, the upper end of the guide member being an end of the guide member positioned furthest from the inlet of the cold air generating compartment.

18. The refrigerator according to claim 17, wherein:

an uppermost one of the blades, which is closest to the upper end of the guide member, has an inclination angle of 70° with respect to the vertical axis;

a lowermost one of the blades, which is farthest from the upper end of the guide member, has an inclination angle of 45° with respect to the vertical axis; and remaining ones of the blades have inclination angles that are between 70° and 45° with respect to the vertical axis and that gradually reduce as the remaining blades are positioned further away from the upper end of the guide member.

19. The refrigerator according to claim 13, wherein a length of the evaporator perpendicular to the flow direction of cold air along the evaporator is longer than a length of the evaporator parallel to the flow direction of the cold air.

* * * * *